US008237366B2

(12) United States Patent
Duffield et al.

(10) Patent No.: US 8,237,366 B2
(45) Date of Patent: Aug. 7, 2012

(54) OUTPUT WINDOW WITH VENTING MEANS FOR USE WITH A VACUUM ELECTRON DEVICE

(75) Inventors: Michael John Duffield, Great Bentley (GB); Richard John North, Chelmsford (GB)

(73) Assignee: E2V Technologies (UK) Limited, Chelmsford (GB)

( * ) Notice: Subject to any disclaimer, the term of this patent is extended or adjusted under 35 U.S.C. 154(b) by 260 days.

(21) Appl. No.: 12/650,104

(22) Filed: Dec. 30, 2009

(65) Prior Publication Data

US 2010/0171423 A1 Jul. 8, 2010

(30) Foreign Application Priority Data

Jan. 6, 2009 (GB) ..... 0900153.8

(51) Int. Cl.
*H01J 23/36* (2006.01)
*H01P 1/08* (2006.01)

(52) U.S. Cl. ..... 315/39.3; 333/252

(58) Field of Classification Search ..... 333/252, 333/35; 315/39.3

See application file for complete search history.

(56) References Cited

U.S. PATENT DOCUMENTS 4,688,009 A 8/1987 Ferguson et al.
5,136,272 A 8/1992 Kormann et al.
5,488,336 A * 1/1996 Rivera et al. ..... 333/252

FOREIGN PATENT DOCUMENTS

GB 913803 A 12/1962

OTHER PUBLICATIONS

Denisov, et al. "Gyro-TWT with a Helical Operating Waveguide: New Possibilities to Enhance Efficiency and Frequency Bandwith," IEEE Transactions on Plasma Science, vol. 26, No. 3, 508-518, (Jun. 1998).

United Kingdom Search Report, dated Apr. 9, 2010, issued in related British Application No. GB100031.3.

* cited by examiner

*Primary Examiner* — Benny Lee

(74) *Attorney, Agent, or Firm* — Venable LLP; Robert Kinberg; Christopher Ma

(57) ABSTRACT

An output window for a vacuum electron device comprises an output waveguide, an intermediate layer of dielectric material joined to the interior of the output waveguide with a vacuum-tight seal, and upper and lower layers of dielectric material spaced apart from the intermediate layer and arranged above and below, respectively, the intermediate layer in a vertical orientation of the output waveguide. The upper and lower layers including openings. Supports extend inwardly into the output waveguide and support the upper and lower layers. Pillars extend through the openings in the lower layer and support the intermediate layer. The openings in the upper and lower layers permit a venting of a region between the upper layer and the intermediate layer and a region between the lower layer and the intermediate layer during the sealing of the intermediate layer while the intermediate layer is supported by the pillars.

19 Claims, 2 Drawing Sheets

OUTPUT WINDOW WITH VENTING MEANS FOR USE WITH A VACUUM ELECTRON DEVICE

CROSS-REFERENCE TO RELATED APPLICATIONS

This application claims priority to GB 0900153.8 filed in the United Kingdom on Jan. 6, 2009, the disclosure of which is incorporated herein by reference in its entirety.

BACKGROUND OF THE INVENTION

This invention relates to output windows of vacuum electron devices.

For vacuum electron devices with circular multi-mode output waveguide designs, the output window normally consists of one or more layers of dielectric, at least one of which will be joined to the device's output waveguide in a vacuum-tight bond, usually achieved by brazing the dielectric to the metal waveguide. While a single layer output window gives excellent transmission at a sequence of defined wavelengths, to achieve broadband performance, a multi-layered window should be used.

Theoretically the bandwidth performance of a single half-wavelength-thick window design can be improved via the use of quarter wavelength transformers abutting the two faces of the window in order to match the window impedance to the free space impedance. To space the triple layers of the window takes this concept one step further, and spaced triple windows have been proposed for electron tubes. Thin ceramic layers may be spaced from the central half-wavelength-thick window to form "matching" cavities. These cavities enable the bandwidth of the window to be significantly extended beyond 20% (a range extending from 10% below the center frequency to 10% above the center frequency) with a return loss of better than −25 dB. This is true for both single and multi mode circular waveguides.

The invention is especially concerned with output windows for gyrotron-travelling wave tube electron devices, although it is also applicable to other broadband vacuum electron devices.

Referring to FIG. 1 of the accompanying drawings, which is a schematic axial cross-section of a known gyrotron-travelling wave tube (gyrotron-TWT) with a conventional broadband output window, and also to FIG. 2, which is a schematic axial cross-section of the output window on an enlarged scale (turned through 90 degrees), the gyrotron-TWT depicted in FIG. 1 consists of a waveguide 1 which is the interaction region between an electron beam from an electron gun 2 and an input rf electromagnetic wave, launched along waveguide sidearm 3, it is desired to amplify. The electron beam undergoes a helical path along the waveguide 1 under the influence of solenoid 4. The waveguide 1 is evacuated, one end being closed by a wall 5 and by another wall (not shown) behind the electron gun 2, and a flared region 6 connects the other end to an output waveguide 7, which is sealed by a conventional triple output window, indicated generally by the reference numeral 8, from which the amplified rf signal is launched.

The interior of the waveguide 1 may be provided with a helical corrugation (not shown)—"Gyro-TWT with a Helical Operating Waveguide: New Possibilities to Enhance Efficiency and Frequency Bandwidth", Gregory G. Denisov, Vladimir L. Bratman, Alan D R Phelps and Sergei V Samsonov, IEEE Transactions on Plasma Science, Vol. 26, No. 3, June 1998. In view of the broadband nature of the output, a spaced triple layer window is used. For optimum performance the design should be symmetrical about the central window. The performance of such a design is very sensitive to dimensional variations, with spacing and ceramic thickness tolerances of tighter than ±0.05 mm necessary to ensure 20% bandwidth performance does not degrade beyond −20 dB return loss.

The conventional approach to manufacture such a spaced triple layer window is similar to that employed for pillbox windows used to vacuum seal rectangular waveguides, i.e. each ceramic disc is first brazed into a copper tube which is then lapped to the desired length. For the triple layer window, which is shown on an enlarged scale in FIG. 2, three such ceramic discs 9, 10, and 11 are brazed to respective copper tubes. The copper tubes that make up waveguide 7 are then brazed together at joints 12, 13 to form the complete assembly. Such a manufacturing approach has a significant risk of introducing tilt between the ceramics discs and consequent mode conversion when the triple layer window is mounted in multi-mode waveguide. In addition, the nature of the spaced triple layer window 8 (FIG. 1) design results in trapped volumes between the ceramic layers. If these volumes are not vented by some means, they may lead to failure of the vacuum bond during subsequent processing of the window assembly.

An alternative approach that has been employed is to sandwich accurately machined copper cylinders between the ceramic layers and place the entire assembly within an outer copper tube, such that the ceramic layers appear to the microwave signal as being set in recesses in a copper tube. Unfortunately for waveguides with a large number of possible propagating modes the differential expansion between the copper and ceramic materials require significant recess depths to be employed, which degrades the microwave performance of the window assembly such that the 20% bandwidth with a return loss of better than −20 dB cannot readily be achieved.

SUMMARY OF THE INVENTION

The present invention provides an output window for a vacuum electron device, comprising an output waveguide, an intermediate layer of dielectric material joined to the interior of the output waveguide with a vacuum-tight seal, layers of dielectric material spaced apart from the intermediate layer and which, in an orientation of the output waveguide in which the seal was made, are higher and lower than the intermediate layer, supports being provided extending inwardly into the outer waveguide and openings being provided in the upper and lower layers such that, in the orientation in which the sealing of the intermediate layer took place, the upper and lower layers were supported by the supports and the intermediate layer was able to be supported through the openings in the lower layer by pillars, while at the same time the regions between the intermediate layer and the upper and lower layers were able to be vented.

The invention also provides a method of making an output window for a vacuum electron device, comprising the steps of supporting upper and lower layers of dielectric material on supports extending into an output waveguide, supporting an intermediate layer of dielectric material between the upper and lower layers in spaced relationship therewith on pillars extending through openings in the lower layer, and making a vacuum-tight seal between the intermediate layer and the interior of the output waveguide.

The openings in the layers of dielectric material in conjunction with the supports allows the three dielectric layers to be secured simultaneously, thus simplifying the manufacturing process.

DETAILED DESCRIPTION OF THE INVENTION

Figure 1:
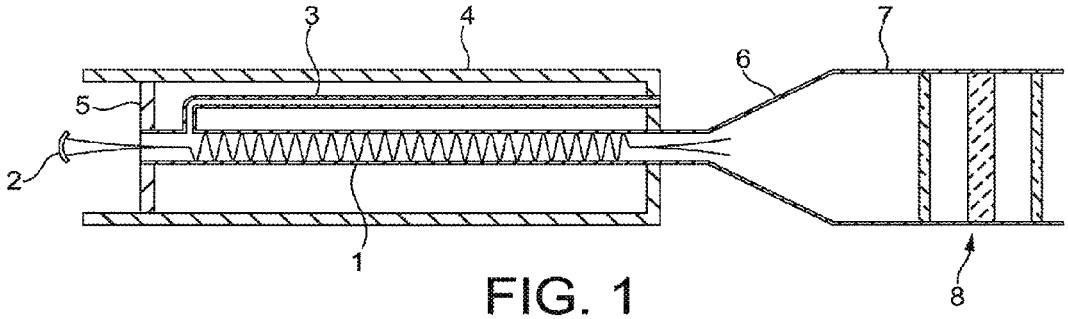
FIG. 1 (Prior Art)
FIG. 1 is a schematic axial cross-section of a known gyrotron-travelling wave tube (gyrotron-TWT) with a conventional broadband output window.

In the following description, like parts have been given like reference numerals throughout all the drawings.

Figure 3:
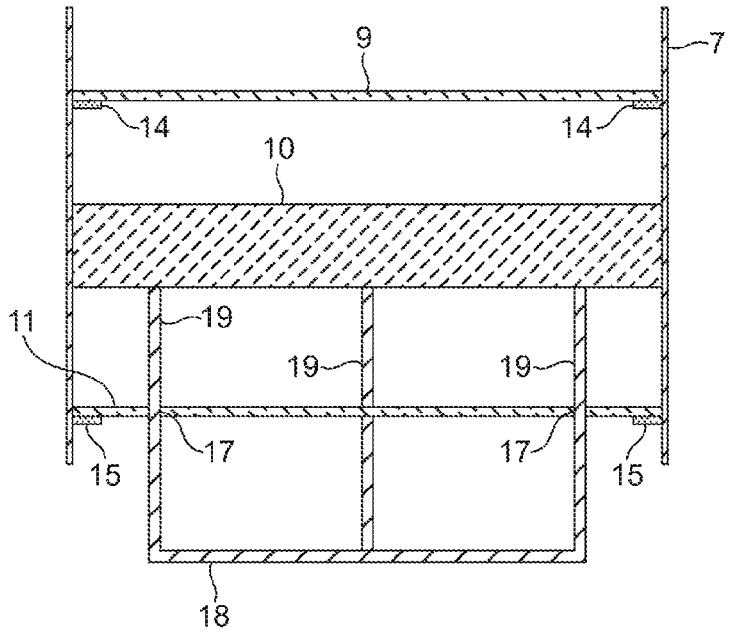
FIG. 3 is a schematic axial cross-section of the output window according to the invention.
Figure 4:
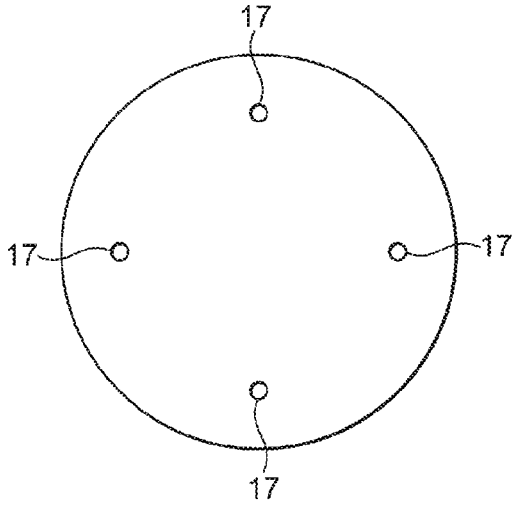
FIG. 4 is a plan view of the lower layer of dielectric material shown in FIG. 3.
Figure 5:
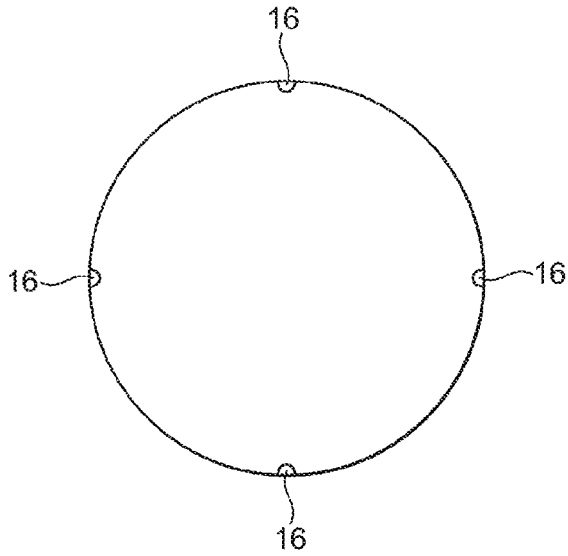
FIG. 5 is a plan view of the upper layer of dielectric material shown in FIG. 3.

The output window shown in FIGS. 3 to 5 forms the output window of a gyrotron-TWT as shown in FIG. 1.

As best depicted in FIG. 3, the window consists of three layers of dielectric material mounted in an output waveguide 7, namely, an intermediate layer 10, and an upper layer 9 and a lower layer 11. The thickness of the intermediate layer is approximately one quarter of the wavelength of the center frequency of the band of frequencies transmitted by the window, and the thickness of the upper and lower layers are respectively approximately one twentieth of the center frequency. The spacing between the upper layer and the intermediate layer, and between the intermediate layer and the lower layer, is respectively approximately one eighth of the center frequency.

These dimensions satisfy the 20% bandwidth requirement for a particular waveguide size and ceramic material, and if the waveguide diameter were to be changed, the thickness and spacing ratios would be different.

Figure 2:
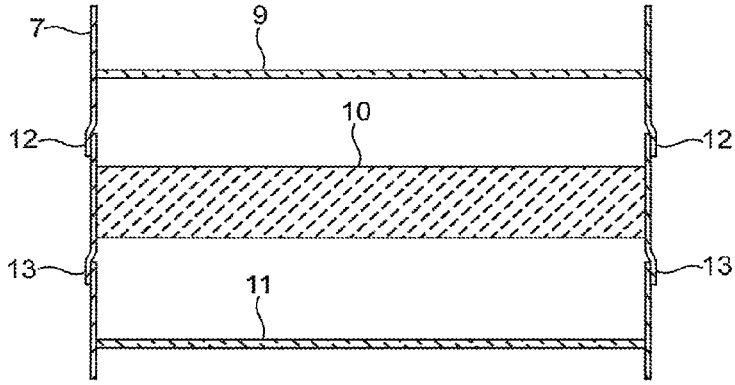
FIG. 2 (Prior Art)
FIG. 2 is a schematic axial cross-section of the output window of FIG. 1 on an enlarged scale (turned through 90 degrees).

Referring to FIGS. 3 to 5, the output window consists of the same layers of dielectric material as were used for the known triple layer design of FIG. 2. According to the invention, the manufacture of the window is greatly simplified.

Thus, the output window is manufactured with the output waveguide 7 in the vertical orientation shown in FIG. 3. Further, the output waveguide has two sets of four equally-spaced inwardly-projecting supports (hereinafter referred to as "corbels"), one set 14 for the upper layer 9, and the other set 15 for the lower layer 11. In addition, the upper layer has four equally-spaced openings 16 (FIG. 5) indented into the periphery, and the lower layer has four equally-spaced openings 17 (FIG. 4) inset from the periphery.

In order to locate the intermediate layer in the correct position during manufacture, it is supported on a jig 18 which includes four upstanding pillars 19 (one of which cannot be seen in the section of FIG. 3), which are sized to be able to pass through the inset openings 17 as shown in FIG. 3.

With the layers 9, 11 supported on the sets of corbels 14, 15, and the intermediate layer supported on the pillars 19, the three layers are simultaneously brazed to the interior of the output waveguide. The openings 17 are of greater diameter than the pillars, and thus the regions above and below the intermediate layer are vented during the brazing process.

The venting holes within the two thin ceramic layers eliminate trapped volume problems which would otherwise arise and allow pillars to pass through the ceramic and hold off the intermediate layer at the desire spacing during brazing. With careful design the corbels, even though non-symmetric, do not degrade the microwave performance and in particular do not cause mode conversion, thus enabling the introduction of corbels on to the inner wall of the output waveguide to support the upper thin layer. By careful consideration of the material expansion coefficients, the use of corbels and pillars the spaced triple layer window assembly can be brazed in it entirety, achieving the required dielectric layer spacing without the need for subsequent mechanical adjustment and hence the desired microwave performance whilst reducing the likelihood of assembly induced mode conversion.

The output waveguide can be a copper tube. The layers of dielectric material can be discs of ceramic such as alumina. While the output waveguide is part of a gyrotron-TWT as described, it could be used with other broadband electron tubes such as coupled cavity TWTs.

The invention has been described in detail with respect to various embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

The invention claimed is:

1. An output window for a vacuum electron device, comprising:

an output waveguide;

an intermediate layer of dielectric material joined to the interior of the output waveguide with a vacuum-tight seal;

upper and lower layers of dielectric material spaced apart from the intermediate layer and arranged above and below, respectively, the intermediate layer in a vertical orientation of the output waveguide, the upper and lower layers including respective openings;

supports extending inwardly into the output waveguide and supporting the upper and lower layers, respectively;

pillars extending through the openings in the lower layer and supporting the intermediate layer;

wherein the openings in the upper and lower layers permit a venting of a region between the upper layer and the intermediate layer and a region between the lower layer and the intermediate layer during the sealing of the intermediate layer while the intermediate layer is supported by the pillars.

2. An output window as claimed in claim 1, wherein the upper and lower layers are respectively joined to the interior of the output waveguide.

3. An output window as claimed in claim 1, wherein each layer is sealed to the interior of the output waveguide by brazing.

4. An output window as claimed in claim 1, wherein the intermediate layer has a thickness of approximately one quarter of the wavelength of a center frequency of a band transmitted by the window.

5. An output window as claimed in claim 4, wherein the spacing between each of the upper and lower layers and the intermediate layer is respectively approximately one eighth of the wavelength of the center frequency of the band transmitted by the window.

6. An output window as claimed in claim 4, wherein the upper and lower layers each have a thickness of approximately one twentieth of the center frequency of the band transmitted by the window.

7. An output window as claimed in claim 1, wherein each of the layers of dielectric material comprises ceramic material.

8. An electron device having an output window as claimed in claim 1.

9. An electron device as claimed in claim 8, in which the device is a gyrotron travelling wave tube.

10. A method of making an output window for a vacuum electron device, comprising the steps of:

supporting upper and lower layers of dielectric material on supports extending into an output waveguide;

supporting an intermediate layer of dielectric material between the upper and lower layers in spaced relationship therewith on pillars extending through openings in the lower layer; and sealing the intermediate layer to the output waveguide to provide a vacuum-tight seal between the intermediate layer and the interior of the output waveguide.

11. A method as claimed in claim 10, including providing the openings in the upper and lower layers to enable regions between the intermediate layer and the upper and lower layers, respectively, to be vented during the sealing step.

12. A method as claimed in claim 10, including joining the upper and lower layers to the interior of the output waveguide.

13. A method as claimed in claim 10, including the steps of brazing each layer to the interior of the output waveguide.

14. A method as claimed in claim 10, including providing the thickness of the intermediate layer to be approximately one quarter of the wavelength of a center frequency of a band transmitted by the window.

15. A method as claimed in claim 14, including providing the spacing between each of the upper and lower layers and the intermediate layer to be respectively approximately one eighth of the wavelength of the center frequency of the band transmitted by the window.

16. A method as claimed in claim 14, including providing the thickness of each of the upper and lower layers to be respectively approximately one twentieth of the center frequency of the band transmitted by the window.

17. A method as claimed in claim 10, including making each of the layers of dielectric material of ceramic material.

18. A method of making an electron device, comprising the steps of making an output window as claimed in claim 10.

19. A method as claimed in claim 18, wherein the electron device is a gyrotron travelling wave tube.

* * * * *